US007566264B2

(12) United States Patent
Votaw et al.

(10) Patent No.: US 7,566,264 B2
(45) Date of Patent: Jul. 28, 2009

(54) SMALL DUCT HIGH VELOCITY DAMPER ASSEMBLY

(75) Inventors: Mark A. Votaw, North Canton, OH (US); Joseph Ramunni, Wadsworth, OH (US); Thomas Delp, Aurora, OH (US); Dennis Laughlin, Chardon, OH (US); Al Zelczer, University Heights, OH (US); Leonard Roth, University Heights, OH (US); Vladimir Sipershteyn, Independence, OH (US); Alexander Avruschenko, Reminderville, OH (US)

(73) Assignee: Arzel Zoning Technology, Inc., Cleveland, OH (US)

( * ) Notice: Subject to any disclaimer, the term of this patent is extended or adjusted under 35 U.S.C. 154(b) by 0 days.

(21) Appl. No.: 11/463,491

(22) Filed: Aug. 9, 2006

(65) Prior Publication Data

US 2007/0178824 A1 Aug. 2, 2007

Related U.S. Application Data

(63) Continuation-in-part of application No. 11/336,386, filed on Jan. 20, 2006, now abandoned.

(51) Int. Cl.
*F24F 13/10* (2006.01)
*F16K 7/04* (2006.01)
*F24F 11/00* (2006.01)

(52) U.S. Cl. ..... 454/333; 454/254; 251/5; 251/61.1

(58) Field of Classification Search ..... 454/256, 454/333, 254; 251/5, 61.1
See application file for complete search history.

(56) References Cited

U.S. PATENT DOCUMENTS 2,590,215 A * 3/1952 Sausa ..... 138/45
2,598,207 A * 5/1952 Bailey et al. ..... 251/61.1
2,972,464 A * 2/1961 Jones et al. ..... 251/5
2,982,511 A * 5/1961 Connor ..... 251/5

(Continued)

FOREIGN PATENT DOCUMENTS

DE 3102363 A1 * 8/1982

*Primary Examiner*—Steven B McAllister
*Assistant Examiner*—Patrick F. O'Reilly, III
(74) *Attorney, Agent, or Firm*—Hahn Loeser & Parks, LLP; Timothy D. Smith

(57) ABSTRACT

A SDHV damper assembly and methods to assemble and install the SDHV damper assembly are disclosed. The SDHV damper assembly includes a first damper housing half comprising a substantially cylindrical tube having a first open end and a second open end. The SDHV damper assembly further includes a second damper housing half comprising a substantially cylindrical tube having a first open end and a second open end. The first open end of the second damper housing half is joined to the first open end of the first damper housing half to form an assembled damper housing. A recess is formed in the damper housing either diametrically or longitudinally. The expandable damper member is received within the recess and expands to restrict flow in the damper housing and retracts to allow laminar flow through the damper housing.

14 Claims, 12 Drawing Sheets

U.S. PATENT DOCUMENTS 3,397,860 A * 8/1968 Bushmeyer ..... 251/61.1
3,490,732 A * 1/1970 Leroy ..... 251/5
3,552,712 A * 1/1971 Whitlock ..... 251/5
4,268,005 A * 5/1981 Raftis et al. ..... 251/5
4,545,524 A * 10/1985 Zelczer ..... 236/46 R
4,702,412 A * 10/1987 Zelczer et al. ..... 236/46 R
4,783,045 A * 11/1988 Tartaglino ..... 251/61.1
5,170,986 A * 12/1992 Zelczer et al. ..... 251/61.1
5,277,397 A * 1/1994 Tartaglino ..... 251/61
5,300,047 A * 4/1994 Beurrier ..... 604/264
5,399,121 A * 3/1995 Gray et al. ..... 454/137
5,458,148 A * 10/1995 Zelczer et al. ..... 137/15.17
5,806,830 A * 9/1998 Alvarez ..... 251/145
6,786,473 B1 9/2004 Alles
6,997,390 B2 2/2006 Alles
7,032,875 B2 * 4/2006 Sterner et al. ..... 251/5
7,062,830 B2 6/2006 Alles
7,302,959 B2 * 12/2007 Gonia ..... 137/2

* cited by examiner

SMALL DUCT HIGH VELOCITY DAMPER ASSEMBLY

CROSS-REFERENCE TO RELATED APPLICATIONS/INCORPORATION BY REFERENCE

This patent application is a continuation in part patent application claiming priority to U.S. patent application Ser. No. 11/336,386 filed on Jan. 20, 2006, which is incorporated herein by reference in its entirety. Additionally, U.S. Pat. No. 5,458,148, issued on Oct. 17, 1995, is incorporated herein by reference in its entirety. Also, pending U.S. patent application Ser. No. 11/226,165, filed on Sep. 14, 2005, is incorporated herein by reference in its entirety.

TECHNICAL FIELD

Certain embodiments of the present invention relate to damper assemblies for heating venting and air conditioning (HVAC) systems. More particularly, certain embodiments of the present invention relate to a small duct high velocity (SDHV) damper assembly and methods of assembling and installing the SDHV damper assembly.

BACKGROUND OF THE INVENTION

Various types of damper devices have been developed over the years to control the flow of fluid through ducts in low velocity HVAC systems (i.e., provide zone control). The damper devices are used to control the flow of air through the systems' air ducts and range from a simple hand-tumable damper vane often found in residential buildings to motor driven mechanical damper assemblies more commonly used in commercial and industrial structures. Another type of damper device employs an inflatable bladder or bellows to control fluid flow through a duct, and details of particularly useful bladder-type flow control devices and associated systems can be found in U.S. Pat. Nos. 4,545,524, and 4,702,412. One advantage of the bladder-type flow control devices shown in these patents is that they could be easily retrofitted into existing ducts with minimal difficulty.

Another prior art type of damper device for low velocity HVAC systems is a mechanical damper assembly comprising a short piece of metal duct in which a damper vane is provided with a shaft that is pivotally mounted for rotation in the short piece of metal duct. The damper vane is rotated between open and closed positions by a motor mounted to and outside the duct piece and connected to the damper vane shaft.

The aforesaid type of mechanical damper assembly is somewhat difficult to install in an existing low velocity metal duct. Installation requires the duct piece of the damper assembly to be spliced into the existing low velocity duct. This involves cutting out a length of the existing metal duct and usually dismantling of the existing metal duct to enable such cutting and/or assembly of the duct piece between adjacent sections of the existing duct. This dismantling, cutting, and reassembling of the metal ductwork is time consuming and, therefore, an expensive operation when performed by paid installers.

The damper vanes in prior art mechanical damper assemblies heretofore have been driven by both electric and fluid motors. A drawback of electric damper motors is that often their life cycle is comparatively short and limited, thereby making motor replacement a relatively frequent and expensive maintenance operation. Another problem is that, in systems employing a considerable number of electric motor driven dampers, relatively complicated wiring schemes and transformers are often involved, all adding to the cost and complexity of the overall system. Fluid motors eliminate the electrical wiring problems and often have comparatively longer life cycles, but they too have had drawbacks associated therewith. Even with so-called frictionless diaphragm-type fluid motors, the actuator members thereof are typically engaged by bearings and wipers that still hinder free linear movement of the members. Also, to reduce friction, the members are often made of hardened steel as opposed to less expensive materials.

U.S. Pat. No. 5,458,148, which is incorporated herein by reference, describes a fluid flow control damper assembly that overcomes many of the drawbacks associated with the damper assemblies described above herein. In this patent, a damper assembly comprises a support base for external mounting to a side of a duct. A damper vane is mounted to the support base for movement between open and closed positions. The damper vane is located inwardly of the inner side of the support base for positioning interiorly of the duct when the support base is mounted to the duct. An actuator is mounted to the support base and operatively connected to the damper vane for moving the damper between open and closed positions. The support base includes a closure for closing an access opening in a side wall of the duct of sufficient size to permit insertion of the damper vane therethrough. The closure includes a mounting member and a gasket at the inner side of the mounting member for providing a seal between the mounting member and the side wall of the duct. The actuator includes a fluid motor of the type including a diaphragm. The damper vane may be pivotally mounted to the end of a mounting post extending inwardly from the support base and the fluid motor may have an actuator member connected to the diaphragm and extending generally parallel to the mounting post for connection to the damper vane.

For SDHV HVAC systems, zone control has been difficult and largely impractical due to a lack of sufficient damper assemblies designed for the unique properties and characteristics of SDHV HVAC systems (e.g., higher air velocities and pressures than that of traditional low velocity HVAC systems and smaller diameter duct work, for example, 2 inch diameter duct work). Therefore, a need exists for a damper assembly that may be used in SDHV HVAC systems.

Further limitations and disadvantages of conventional, traditional, and proposed approaches will become apparent to one of skill in the art, through comparison of such systems and methods with the present invention as set forth in the remainder of the present application with reference to the drawings.

SUMMARY OF THE INVENTION

An embodiment of the present invention comprises a damper assembly for controlling the flow of fluid through a duct. The damper assembly includes a first damper housing half comprising a substantially cylindrical tube having a first open end and a second open end. The damper assembly further includes a second damper housing half comprising a substantially cylindrical tube having a first open end and a second open end wherein the first open end of the second damper housing half is joined to the first open end of the first damper housing half to form an assembled damper housing. The damper assembly also includes a substantially elliptical damper blade pivotally mounted within the assembled housing along a minor axis of the damper blade for movement between opened and closed positions. The damper assembly further includes an actuator member having a first end and a second end and being pivotally connected to a first side of the damper blade near the first end of the member. The actuator member extends through an opening in the assembled damper housing toward the second end of the member such that the damper blade pivots about the minor axis when the actuator member is moved along a longitudinal axis of the actuator member. The longitudinal axis is substantially perpendicular to the minor axis. The damper assembly also includes a damper actuator mounted to the assembled damper housing such that the second end of the actuator member is connected to a movable diaphragm of the damper actuator to move the actuator member longitudinally when the damper actuator is pressure or vacuum activated by an air pump.

A further embodiment of the present invention comprises a method of assembling a damper assembly used for controlling the flow of fluid through a duct. The method comprises identifing component parts of the damper assembly including a damper actuator having a damper actuator housing and a protruding actuator member, a damper blade having an axle and at least one bracket, a first damper housing half having a first joining flange with first axle receiver recesses, and a second damper housing half having a second joining flange with second axle receiver recesses. The method further includes pivotally securing the damper blade to the actuator member via the at least one bracket on a back surface of the damper blade. The method also includes loosely securing the first damper housing half to the damper actuator housing. The method further includes aligning the axle of the damper blade with the first axle receiver recesses in the first joining flange of the first damper housing half. The method further comprises tightly securing the second damper housing half to the first damper housing half at the joining flanges such that the axle is also aligned with the second axle receiver recesses in the second joining flange of the second damper housing half. The method also includes aligning the loosely secured damper housing halves to the damper actuator housing and tightly securing the aligned damper housing halves to the damper actuator housing.

Another embodiment of the present invention comprises a method of installing a damper assembly, comprising a damper housing connected to a damper actuator, and used for controlling the flow of fluid through small duct high velocity (SDHV) flex line duct work. The method includes making a cut through a cross-section of the duct work to form two open sections of the duct work. The method further includes inserting a first open end of the damper housing into a first open section of the two open sections of the duct work to form a first joint. The method also includes inserting a second open end of the damper housing into a second open section of the two open sections of the duct work to form a second joint. The method further comprises securing the first joint to hold the first open end within the first open section and securing the second joint to hold the second open end within the second open section. The method also includes sealing the first joint to form a first air tight sealed joint and sealing the second joint to form a second air tight sealed joint. The method further includes connecting a first end of an air supply line to an air inlet port of the damper actuator.

Like all air distribution systems, SDHV HVAC systems depend on moving conditioned air to the living spaces to maintain a desirable temperature in those spaces. The system is scaled and laid out to deliver enough air to maintain the desired temperature during peak load conditions. A problem is that peak conditions occur during only about 10% of the annual duty cycle. During other times, peak delivery will mean that some areas of the building will be too warm while others will be too cool. Zoning combats such a problem by serving only those areas that are demanding service "right now". That is, when thermostats installed in those areas call, air is provided. When the thermostats in certain zones are not calling, the dampers are closed and the air is served somewhere else.

In general SDHV HVAC systems tend to be much more expensive than conventional HVAC systems and are installed in homes that have architectural challenges that preclude standard duct work, or in historical homes that were not designed for cooling and adding conventional duct work. Because air is moved faster in a SDHV HVAC system, the size of the duct work may be reduced. The trunk is typically 6 to 10 inches wide, with 2 inch flexible duct runouts feeding inconspicuous outlets. The small size of the runouts allows contractors to run them inside standard stud walls or through ceilings without having to build "ugly" soffits. The SDHV HVAC system may generate 1-2 inches of water column static pressure inside the SDHV duct work. Airflow is typically around 2400 feet/minute in such SDHV HVAC systems.

It has traditionally been thought that SDHV HVAC systems could not be zoned. Manufacturers have been concerned that raising the static pressure, by closing zone dampers and reducing the effective size of duct work, would cause a severe loss in airflow through the equipment, thereby causing the equipment to become too cold (during cooling) and freeze up. However, the damper assembly as described herein allows for zoning of SDHV HVAC systems. Contractors should follow the equipment manufacturers' recommendations about the total number of runs throughout the system but they should not have less than 3.5 outlets per ton of cooling in any zone. This works well for refrigerant-based air conditioning and heat pump systems. For systems using chillers or boilers, there is no restriction on outlets.

An embodiment of the present invention comprises a damper for controlling the flow of a fluidized medium through high velocity ductwork. The damper includes a generally tubular damper housing having first and second ends where each of the first and second ends may be adapted for insertion into a high velocity ductwork. The damper also includes a selectively expandable damper member diametrically received within the damper housing.

One aspect of the embodiments of the present invention includes a damper housing having a recessed portion fashioned substantially around the circumference of the damper housing, where the damper member is received at least partially within the recessed portion of the damper housing.

In another aspect of the embodiments of the present invention, the damper member is selectively expandable from a first retracted position creating a streamline flow profile to at least a second expanded position creating a restricted flow profile. In the streamline position, the damper member sits substantially flush with the side walls of the damper housing thereby allowing air flow therethrough in a laminar fashion.

In yet another aspect of the embodiments of the present invention, the damper member is collar shaped and may be constructed from an elastically deformable material such as rubber.

Still another aspect of the present invention includes a recessed portion fashioned in the damper housing that comprises at least a first transition region between side walls of damper housing and the recessed portion. The transition region may include a chamfered edge forming an acute angle with respect to a centerline axis of the damper housing.

In another embodiment of the present invention the damper may include a damper housing having first and second ends and a generally longitudinal recess formed in a sidewall of the damper housing where each of the ends is adapted for insertion into high velocity ductwork. A selectively expandable bladder damper member may be received within the generally longitudinal recess.

One aspect of the embodiments of the present invention includes a tube that is extended from the bladder damper member and hermetically sealed with respect to the bladder damper member for communicating pressurized medium to the bladder damper member.

These and other advantages and novel features of the present invention, as well as details of illustrated embodiments thereof, will be more fully understood from the following description and drawings.

DETAILED DESCRIPTION OF THE INVENTION

Figure 1:
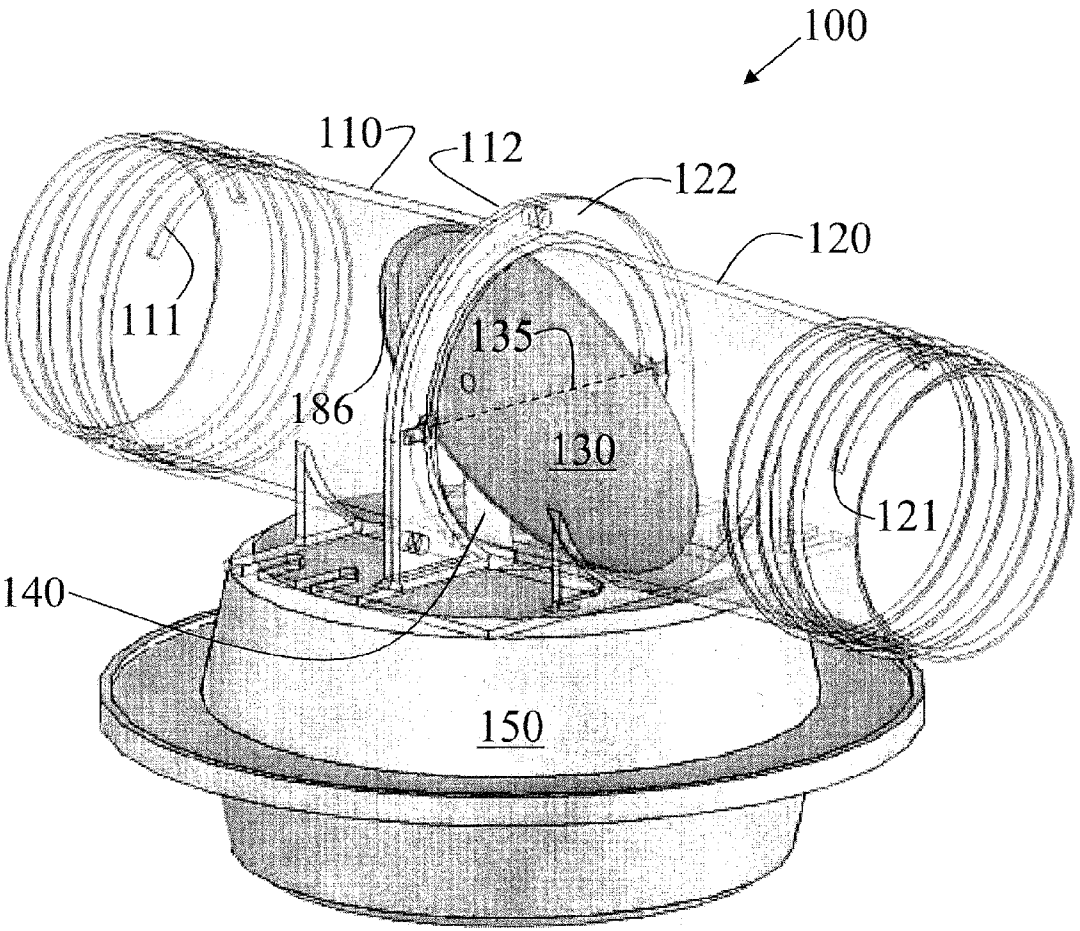
FIG. 1 illustrates a perspective view of an exemplary embodiment of a damper assembly for use in a SDHV HVAC system, in accordance with various aspects of the present invention.
Figure 2:
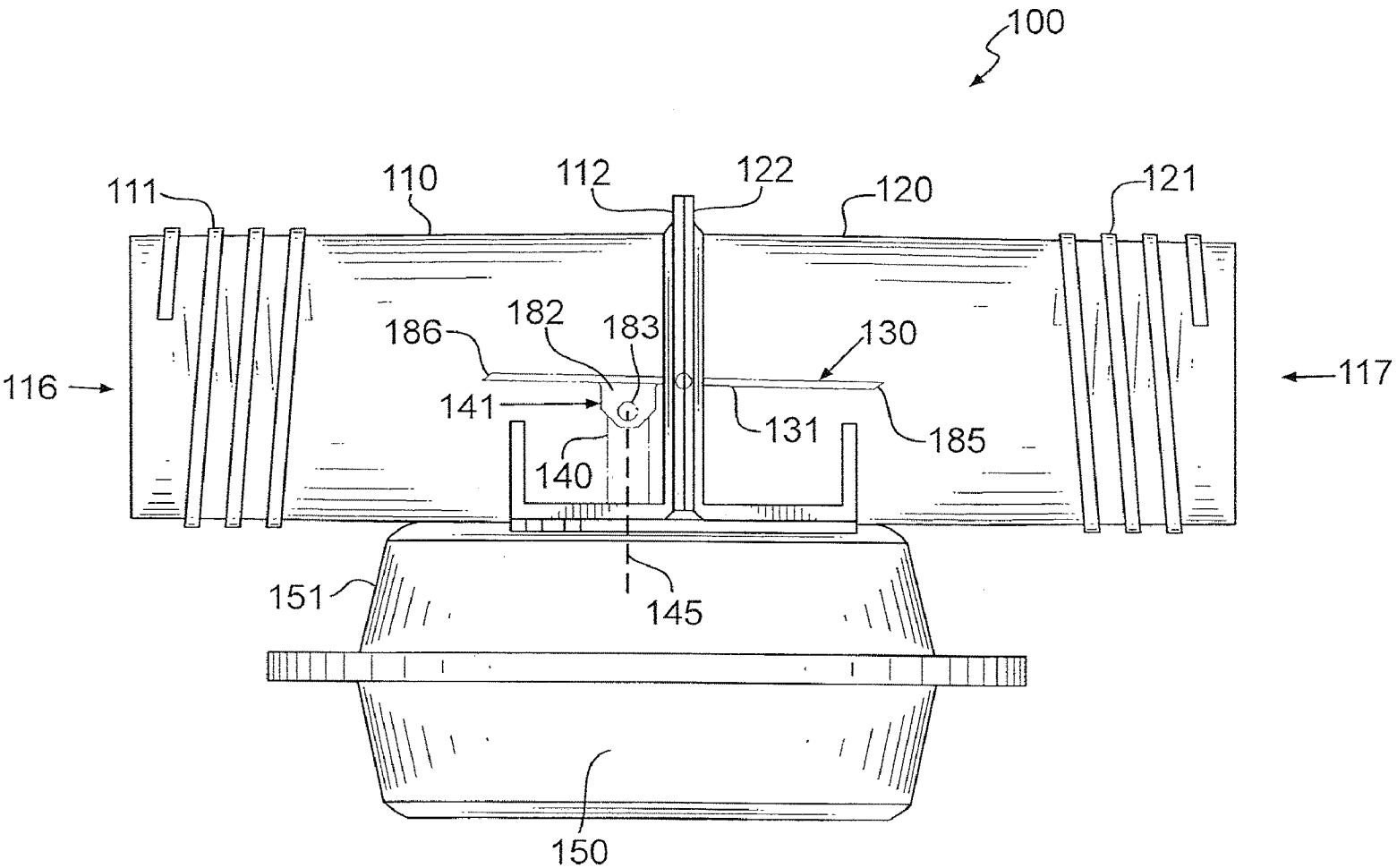
FIG. 2 illustrates a side view of the damper assembly of FIG. 1, in accordance with various aspects of the present invention.

FIG. 1 illustrates a perspective view of an exemplary embodiment of a damper assembly 100 for use in a SDHV HVAC system, in accordance with various aspects of the present invention. The damper assembly 100 is designed to operate in the much higher static pressure environments that a SDHV HVAC system typically produces (e.g., 1 to 2 inches of water column). FIG. 2 illustrates a side view of the damper assembly 100 of FIG. 1, in accordance with various aspects of the present invention. FIGS. 3*a*-3*d* illustrate several different views of the damper assembly 100 of FIG. 1, in accordance with various aspects of the present invention. FIGS. 4*a*-4*c* illustrate several component parts of the damper assembly 100 of FIG. 1, in accordance with various aspects of the present invention.

The damper assembly 100 comprises a first damper housing half 110 comprising a substantially cylindrical tube having two open ends. The damper assembly 100 further comprises a second damper housing half 120 comprising a substantially cylindrical tube having two open ends. The second damper housing half 120 is joined to the first damper housing half 110 to form an assembled damper housing 110 and 120. In accordance with an embodiment of the present invention, the damper housing halves 110 and 120 are substantially identical and made of a molded plastic material. The damper assembly 100 also comprises a substantially elliptical damper blade 130 pivotally mounted within the assembled damper housing 110 and 120 along a minor axis 135 of the damper blade 130 for movement between an open position and a closed position. The open position allows air to flow through the assembled damper housing 110 and 120 and the closed position substantially blocks the flow of air through the damper housing 110 and 120 when installed in a SDHV HVAC system. As used herein, the term "elliptical" means oval or non-circular. That is, the substantially elliptical damper blade has a major axis and a minor axis where the length of the major axis is longer than the length of the minor axis. In other words, a length of the elliptical damper blade is longer than a width of the elliptical damper blade.

Figure 3A:
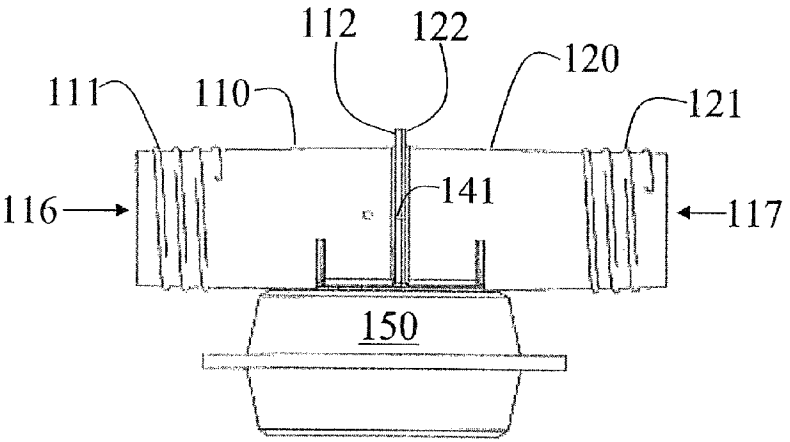
FIGS. 3*a*-3*d* illustrate several different views of the damper assembly of FIG. 1, in accordance with various aspects of the present invention.
Figure 3B:
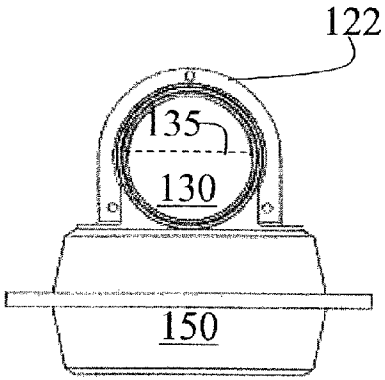
Figure 3C:
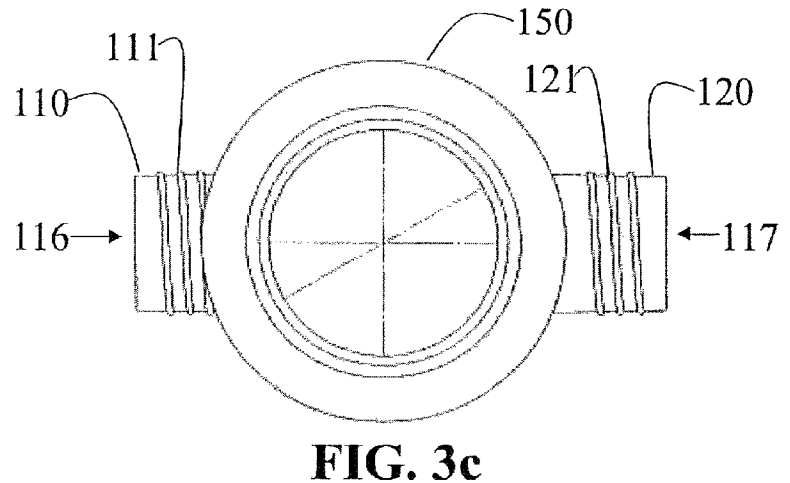
Figure 3D:
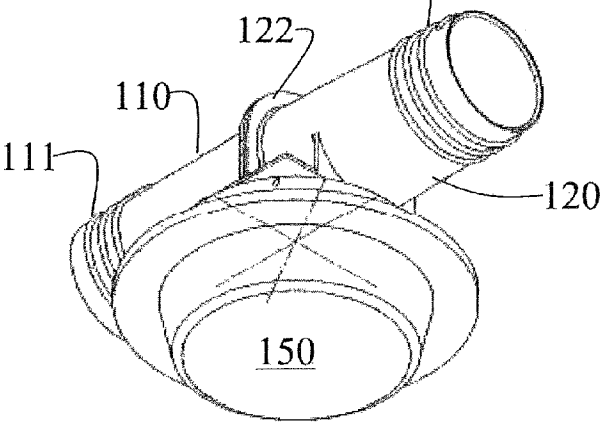
Figure 4B:
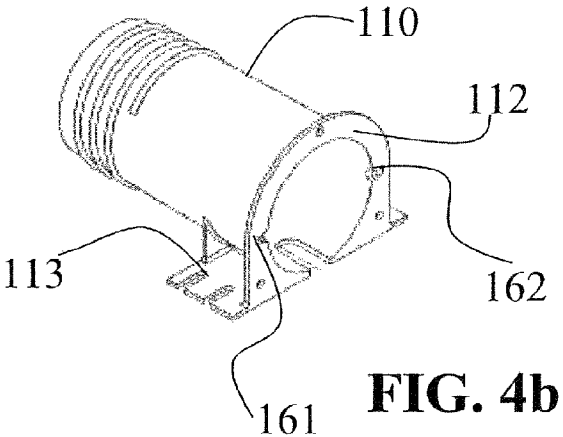
FIGS. 4*a*-4*c* illustrate several component parts of the damper assembly of FIG. 1, in accordance with various aspects of the present invention.
Figure 4A:
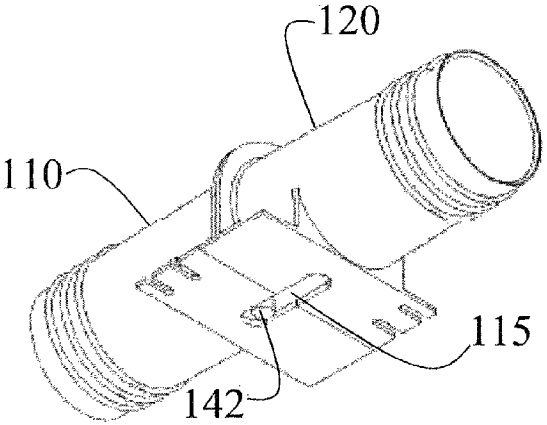
Figure 4C:
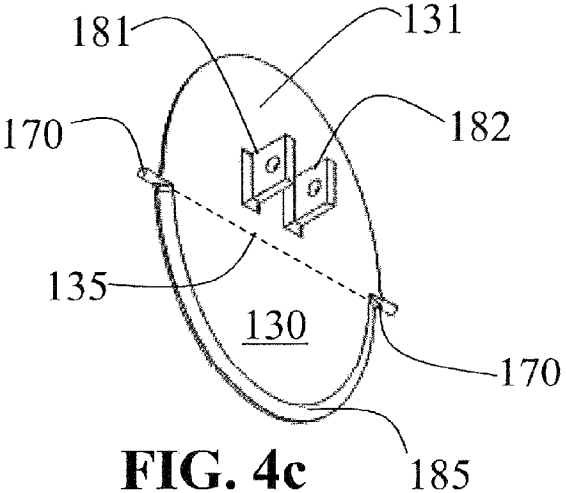

The damper assembly 100 further comprises an actuator member 140 having a first end 141 and a second end 142 (see FIG. 2, FIG. 3*a*, and FIG. 4*a*). The actuator member 140 is pivotally connected to a first side 131 of the damper blade 130 near the first end 141 of the actuator member 140. The actuator member 140 extends through an opening 115 in the assembled damper housing 110 and 120 toward the second end 142 of the actuator member such that the damper blade 130 pivots about the minor axis 135 when the actuator member 140 is moved along a longitudinal axis 145 of the actuator member 140. In accordance with an embodiment of the present invention, the actuator member comprises a rod having longitudinal axis 145 that is substantially perpendicular to the minor axis 135 of the damper blade 130, although the longitudinal axis 145 is in a different plane than the minor axis 135.

The damper assembly 100 also comprises a damper actuator 150 which is mounted to the assembled damper housing 110 and 120 such that the second end 142 of the actuator member 140 is connected to a movable diaphragm (driving element) inside the damper actuator 150. The damper actuator 150 is of the type described in U.S. Pat. No. 5,458,148 which is incorporated herein by reference in its entirety and is an air flow fluid actuator. FIG. 2 of U.S. Pat. No. 5,458,148 illustrates an embodiment of such a damper actuator 150. Referring to FIGS. 1-4 herein, when the actuator member 140 is driven along the direction of the longitudinal axis 145 by forcing air into the damper actuator 150 or by sucking air out of the damper actuator 150, the damper blade 130 pivots about the minor axis 135 between an opened position and a closed position. However, other types of damper actuators may be used as well to drive the actuator member 140 such as, for example, an electric motor actuator.

When air is pulled out of the damper actuator 150, the damper blade 130 is pulled downward and the damper opens allowing air to pass through the damper housing 110 and 120. The damper blade 130 shown in FIG. 2 is in the opened position. When air is pushed into the damper actuator 150, the damper blade 130 is pushed closed and conditioned air flow is blocked. The damper blade 130 shown in FIG. 1 is in the closed position. The oval shape of the damper blade 130 allows the edges of the damper blade 130 to tightly fit against the inner surface of the damper assembly housing halves 110 and 120 when in the closed position. In accordance with an embodiment of the present invention, the bottom or far side of the damper actuator housing 151 of the damper actuator 150 is used as a stop for the actuator member 140 such that the damper blade 130 is fully open at centerline position when the actuator member 140 is stopped as such (i.e., when the air is sucked out of the damper actuator 150).

In accordance with an embodiment of the present invention, the damper assembly housing halves 110 and 120 each include integral threads 111 and 121 on an outside surface of the housing halves 110 and 120. The integral threads 111 and 121 allow the housing halves 110 and 120 to be twisted into SDHV flex line duct on each side 116 and 117 of the damper assembly housing halves 110 and 120 during installation of the damper assembly 100. The threads 111 and 121 help to hold the ends of the housing halves 110 and 120 secure within the SDHV flex line duct. However, in accordance with an alternative embodiment of the present invention, threads are not used (i.e., there are no integral threads on the housing halves 110 and 120).

Each of the damper housing halves 110 and 120 include a joining flange 112 and 122 respectively. The joining flanges 112 and 122 each include two axle receiver recesses 161 and 162 (see FIG. 4*b*) to receive an axle 170 of the damper blade 130. The damper blade 130 includes an axle 170 extending from two opposite edges of the damper blade in line with the minor axis 135. The axle 170, when mounted between the two housing halves 110 and 120 in the recesses 161 and 162 allows the damper blade to pivot about the minor axis 135. The axle 170 may simply comprise an integral nub or extension protruding from each side of the damper blade 130 in line with the minor axis 135 as shown in FIG. 4*c*. Alternatively, the axle 170 may comprise a separate rod extending the entire width of the damper blade 130 along the minor axis 135 and being attached to the damper blade 130. Other axle configurations are possible as well, in accordance with various embodiments of the present invention.

The substantially oval shape of the damper blade 130 limits the amount of side to side movement of the actuator member 140 which reduces flexing of the junction between the member 140 and the diaphragm within the damper actuator 150 to which the second end 142 of the actuator member 140 is connected. Such limited side to side movement promotes long and reliable operation and spreads out the force provided by the actuator member 140 on both the top and bottom of the damper blade 130 as well as the axle 170, allowing the required thickness of the damper blade 130 to be reduced.

In accordance with an embodiment of the present invention the first side 131 of the damper blade 130 includes two brackets 181 and 182 extending from the first side 131 such that the actuator member 140 may be pivotally connected to the damper blade 130 via the two brackets 181 and 182. A pin 183 (see FIG. 2) is used to secure the actuator member 140 to the brackets 181 and 182 by inserting the pin 183 through holes in the brackets 181 and 182 and in the actuator member 140 near the first end 141 of the actuator member 140. The damper blade 130 also includes beveled edges 185 and 186 to provide a tight fit between the edges of the damper blade 130 and an interior surface of the assembled damper housing 110 and 120 when the damper blade 130 is in the closed position, in accordance with an embodiment of the present invention.

In accordance with an embodiment of the present invention, most of the elements of the damper assembly 100 are made of a molded plastic material such as, for example, a polycarbonate/ABS blend for strength, temperature tolerance, and product longevity. Also, flame retardant additives may be used to give the assembly 100 the product V0 rating (i.e., self-extinguishing within a certain time frame).

Figure 5:
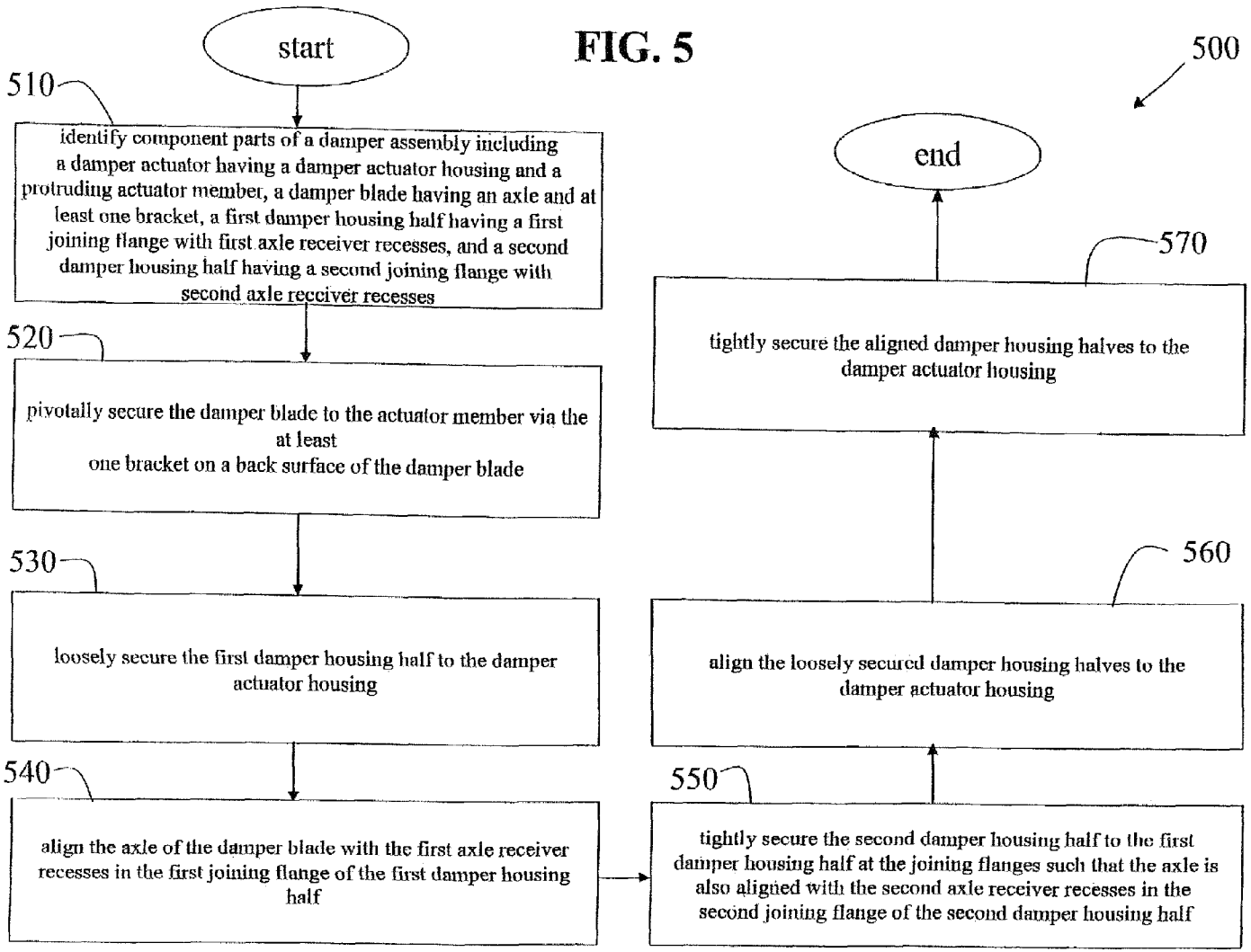
FIG. 5 is a flow chart of an embodiment of a method of assembling the damper assembly of FIG. 1, in accordance with various aspects of the present invention.

FIG. 5 is a flow chart of an embodiment of a method 500 of assembling the damper assembly 100 of FIG. 1, in accordance with various aspects of the present invention. In step 510 the various component parts of the damper assembly 100 are identified including the damper actuator 150 having a damper actuator housing 151 and a protruding actuator member 140, the damper blade 130 having an axle 170 and at least one bracket 181 and 182, a first damper housing half 110 having a first joining flange 112 with first axle receiver recesses 161 and 162, and a second damper housing half 120 having a second joining flange 122 with second axle receiver recesses 161 and 162.

In step 520, the damper blade 130 is pivotally secured to the actuator member 140 via the brackets 181 and 182 on a back surface 131 of the damper blade 130. In accordance with an embodiment of the present invention, the damper blade 130 is pivotally secured to the actuator member 140 by inserting a pin 183 through a hole near the first end 141 of the actuator member and through another hole in each of the brackets 181 and 182 such that the actuator member 140 resides between the two brackets 181 and 182. In accordance with an alternative embodiment of the present invention, only one bracket may be used to pivotally attach the actuator member 140 to the back of the damper blade 130. Other methods of pivotally attaching the actuator member 140 to the back of the damper blade 130 are possible as well, in accordance with other various embodiments of the present invention.

In step 530, the first damper housing half 110 is loosely secured to the damper actuator housing 151. In step 540, the axle 170 of the damper blade 130 is aligned with the first axle receiver recesses 161 and 162 in the first joining flange 112 of the first damper housing half 110. In step 550, the second damper housing half 120 is tightly secured to the first damper housing half 110 at the joining flanges 112 and 122 such that the axle 170 is also aligned with the second axle receiver recesses 161 and 162 in the second joining flange 122 of the second damper housing half 120. The first damper housing half 110 may be loosely secured to the damper actuator housing 151 by screwing a screw through a hole in a base 113 (see FIG. 4*b*) of the first damper housing half 110 and into a corresponding hole in the damper actuator housing 151. The second damper housing half 120 may be secured to the first damper housing half 110 via bolts and nuts where the bolts pass through holes in the joining flanges 112 and 122.

In step 560, the loosely secured damper housing halves 110 and 120 are aligned to the damper actuator housing 151. Aligning the loosely secured damper housing halves 110 and 120 (i.e., loosely secured to the damper actuator housing 151 by one screw but tightly secured to each other by nuts and bolts) to the damper actuator housing 151 includes lining up a screw hole in a base 113 of the second damper housing half 120 with a screw hole in the damper actuator housing 151 by pivoting the connected damper housing halves 110 and 120 about the screw loosely securing the first damper housing half 110. In accordance with an embodiment of the present invention, the damper housing halves 110 and 120 are substantially identical and the joining flanges 112 and 122 are finished such that the resultant joint is air tight up to a static pressure of at least 5 inches of water column (a safety factor of 300%).

In step 570, the aligned damper housing halves 110 and 120 are tightly secured to the damper actuator housing 151. The first damper housing half 110 and the second damper housing half 120 are tightly secured to the damper actuator housing 151 via screws. For example, the screw that is loosely securing the first damper housing half 110 is tightened down and another screw is used to tightly secure the second damper housing half 120 to the damper actuator housing 151 in a similar manner after alignment of the damper housing halves 110 and 120 to the damper actuator housing 151.

Figure 6:
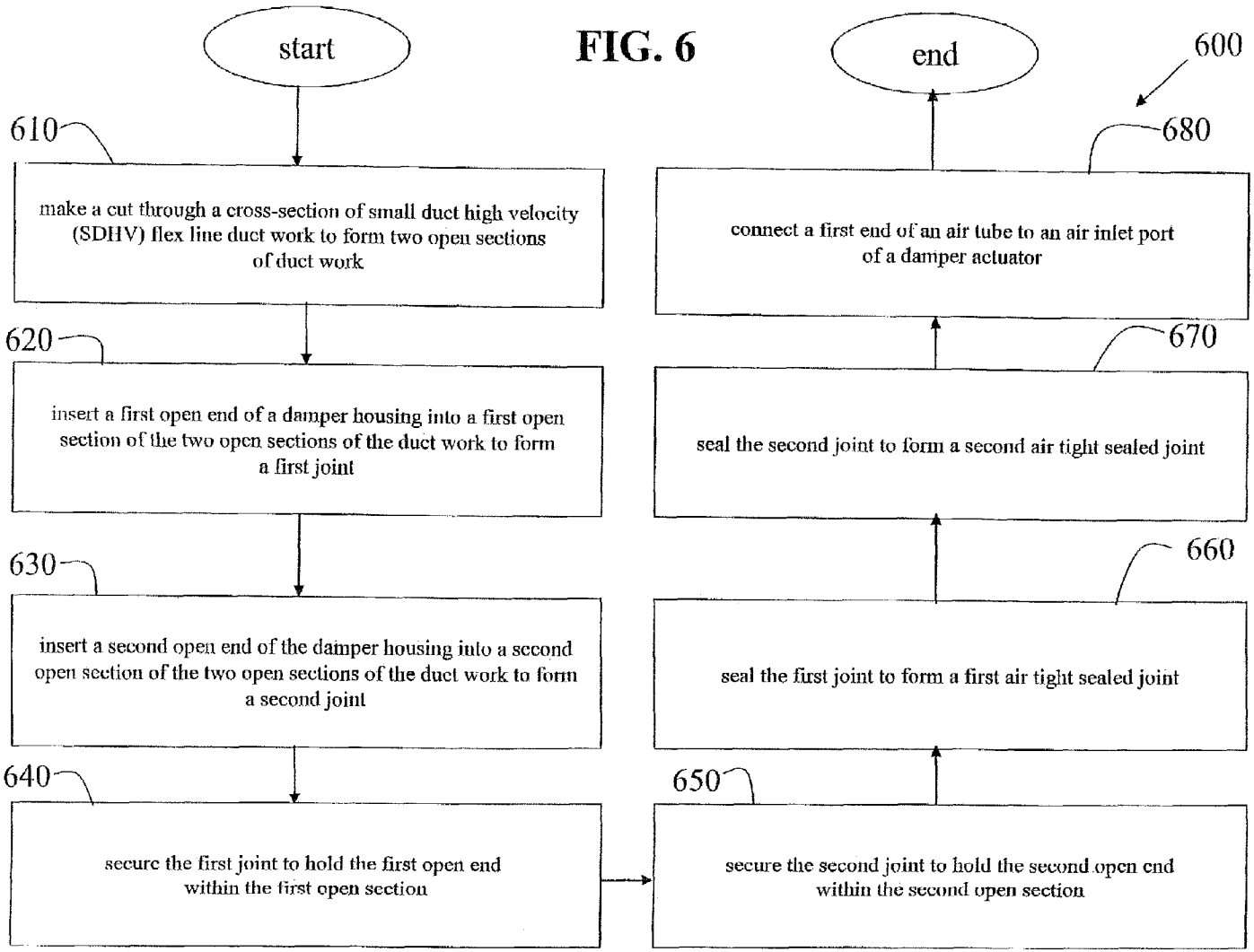
FIG. 6 is a flow chart of an embodiment of a method of installing the damper assembly of FIG. 1, in accordance with various aspects of the present invention.
Figure 7:
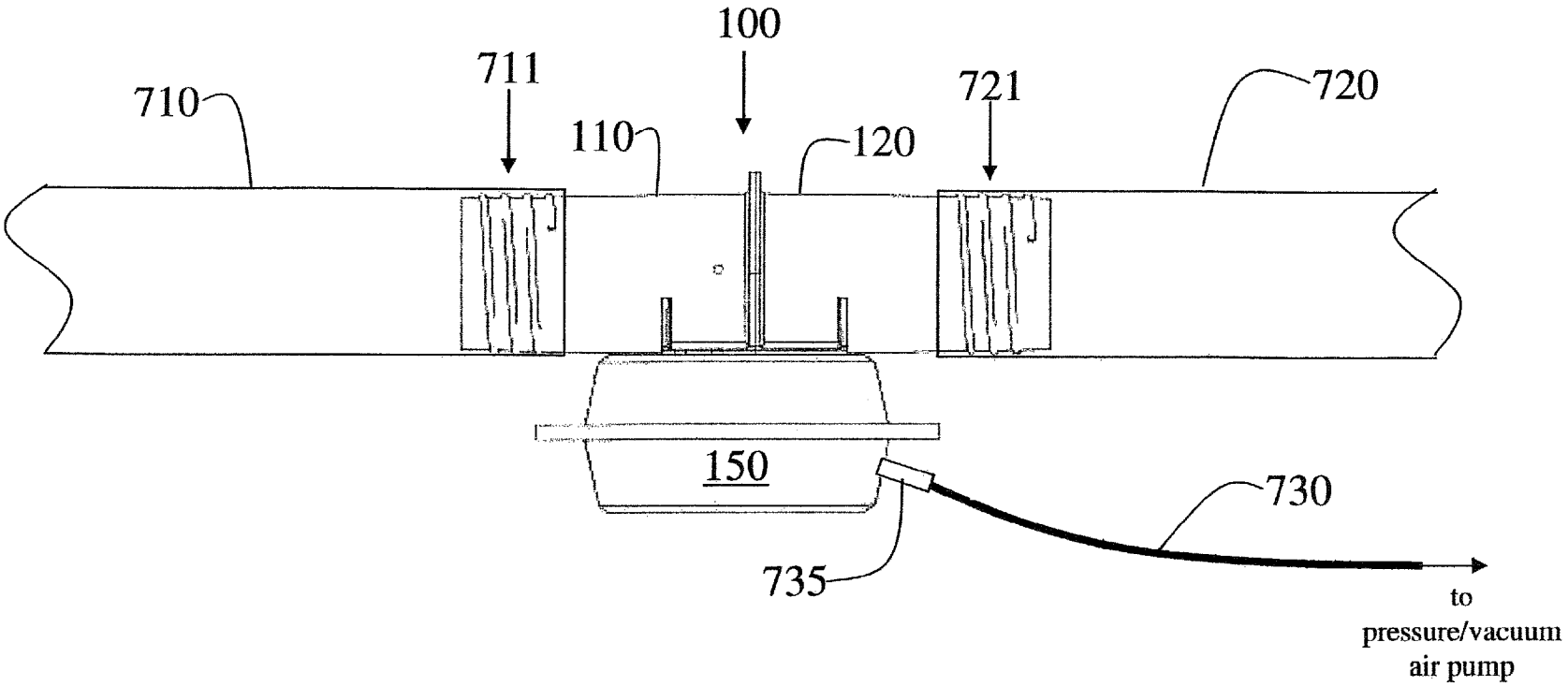
FIG. 7 is an illustration showing the damper assembly of FIG. 1 installed between two sections of SDHV flex line duct work, in accordance with an embodiment of the present invention.

FIG. 6 is a flow chart of an embodiment of a method 600 of installing the damper assembly 100 of FIG. 1, in accordance with various aspects of the present invention. FIG. 7 is an illustration showing the damper assembly 100 of FIG. 1 installed between two sections 710 and 720 of SDHV flex line duct work, in accordance with an embodiment of the present invention.

In step 610 of the method 600, a cut is made through a cross-section of small duct high velocity (SDHV) flex line duct work to form two open sections 710 and 720 of duct work. The cut may be made with a simple box cutter knife or some other cutting tool, for example. In step 620, a first open end 116 of the damper assembly housing 110 and 120 is inserted into the first open section 710 of the duct work to form a first joint 711. In step 630, a second open end 117 of the damper assembly housing 110 and 120 is inserted into the second open section 720 of the duct work to form a second joint 721. Insertion may be accomplished, for example, by twisting the threaded open ends of the damper housing halves 110 and 120 into the two open sections 710 and 720 of the duct work.

In step 640, the first joint 711 is secured to hold the first open end 116 within the first open section 710. In step 650, the second joint 721 is secured to hold the second open end 117 within the second open section 720. The joints 711 and 721 may be secured by, for example, tightening a heavy Nylon cable around each joint. Clamps or other securing means may be used instead. In step 660, the first joint 711 is sealed to form a first air tight sealed joint. In step 670, the second joint 721 is sealed to form a second air tight sealed joint. In accordance with an embodiment of the present invention, air tight duct tape, for example, is used to seal the joints 711 and 721. Other means may be used to seal the joints instead.

In step 680, a first end of an air supply line 730 is connected to an inlet port 735 of the damper actuator 150. A second end of the air supply line 730 may be routed to a pressure/vacuum air pump of the HVAC system and connected to a port of the pressure/vacuum pump. Once the basic installation is completed, as described above, the installed damper assembly 100 may be wrapped using, for example, standard duct wrap in order to protect and insulate the installed damper assembly 100. Since, the damper assembly 100 has no moving external parts and generates no heat, it is safe to wrap the entire assembly 100.

In summary, a SDHV damper assembly and methods to assemble and install the SDHV damper assembly are disclosed. The SDHV damper assembly encloses a substantially elliptical damper blade within two damper housing halves such that the damper blade may pivot about a minor axis of the damper blade. An actuator member ties a damper actuator to the damper blade such that the damper actuator may drive the damper blade between open and closed positions in order to control air flow into a zone.

Figure 8:
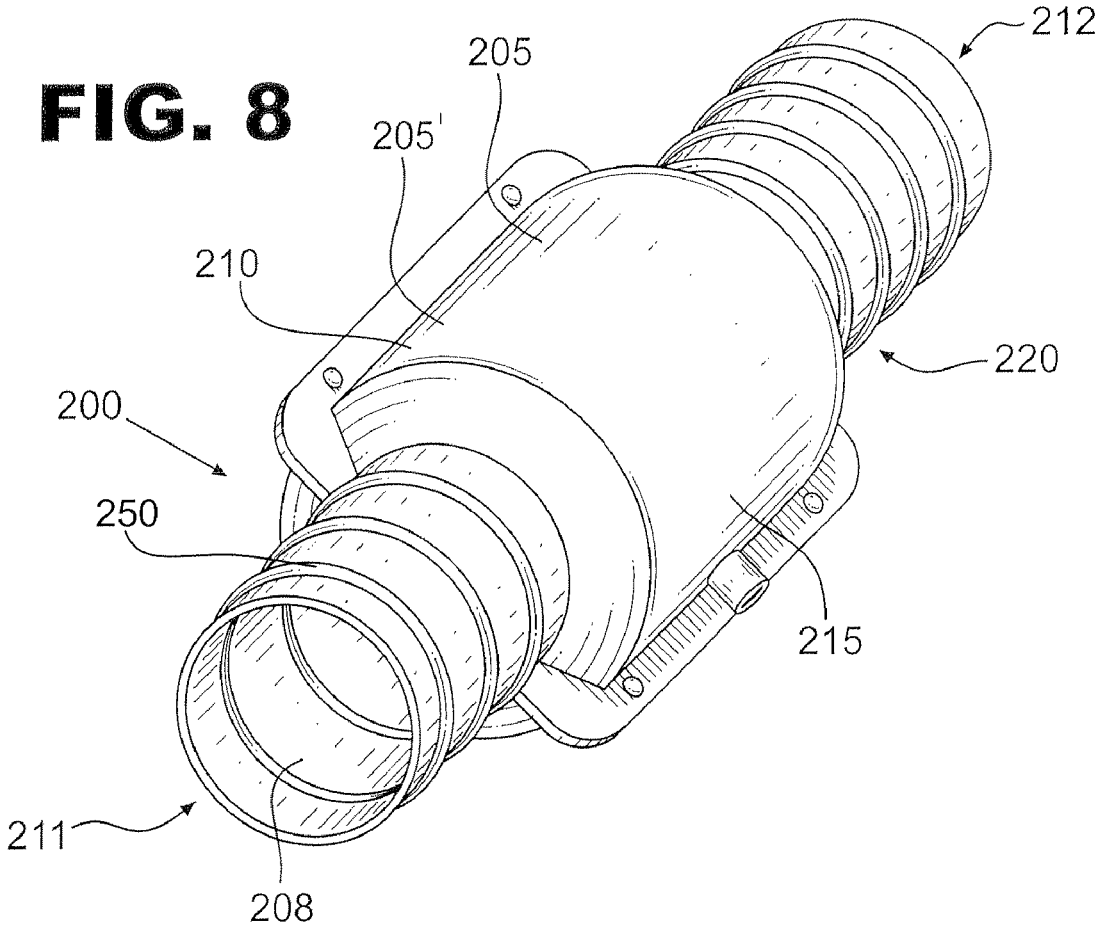
FIG. 8 is an illustration showing a damper assembly having an expandable and retractable collar shaped damper member received within the damper assembly, in accordance with another embodiment of the present invention.

FIG. 8 illustrates a perspective view of an alternate embodiment of a damper assembly 200 for use in a SDHV HVAC system, in accordance with various aspects of the present invention. The damper assembly 200 may include a generally tubular first damper housing half 210 comprising a substantially cylindrical tube having first 211 and second 212 open ends. The damper assembly 200 further includes a generally tubular second damper housing half 220 comprising a substantially cylindrical tube also having first 211 and second 212 open ends. The second damper housing half 220 may be joined to the first damper housing half 210 to form an assembled damper housing 215. In accordance with an embodiment of the present invention, the damper housing halves 210 and 220 are substantially identical and may be made of a plastic or other moldable material. Thus a damper member may be inserted within the damper housing halves 210 and 220 and the damper housing halves thereafter fastened together for controlling the flow of a fluidized medium through high velocity ductwork.

Figure 9:
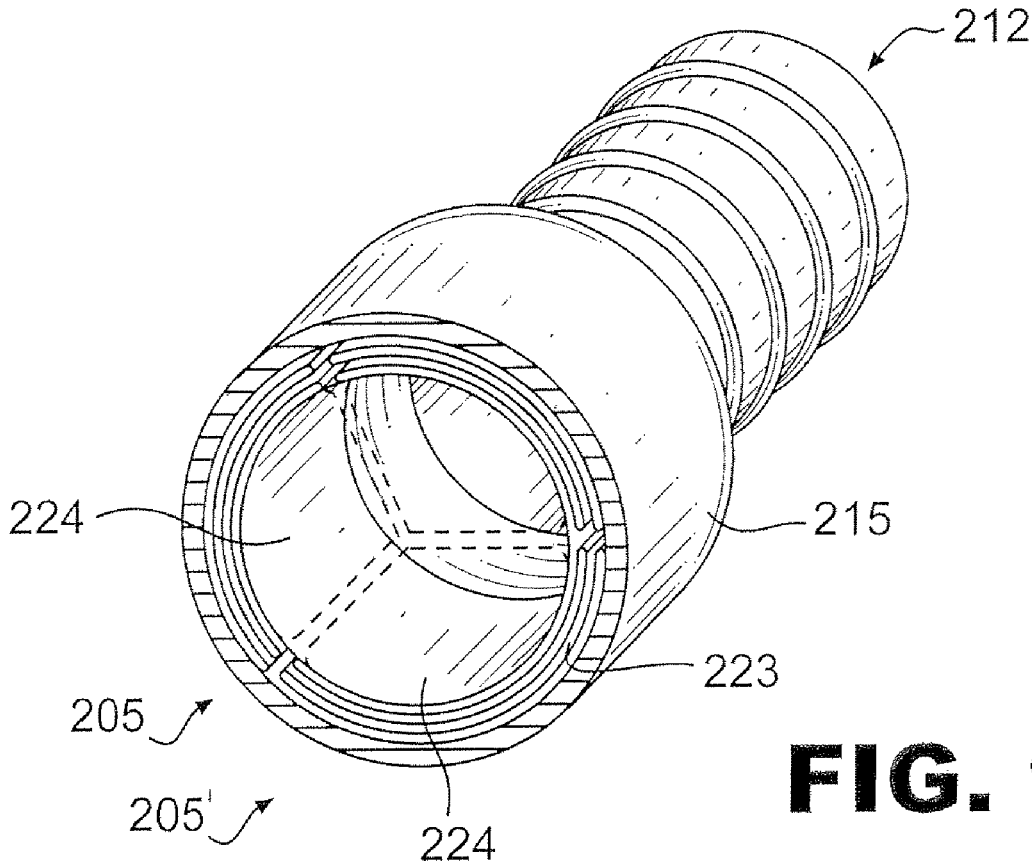
FIG. 9 is a partial cutaway perspective view of the damper assembly and collar shaped damper member, in accordance with another embodiment of the present invention.

With reference to FIGS. 8 and 9, the damper assembly 200 may be constructed having an expanded section 205 fashioned in the damper housing 215. In one embodiment, the expanded section 205 may be fashioned around the entire circumference of damper housing 215 for receiving a damper member, which will be discussed further below. From another frame of reference respective to the high velocity air flowing within the damper housing 215, the expanded section 205 may comprise a recess 205' or trough fashioned within the interior surface or side walls 208 of the damper housing 215 and spanning along a prescribed length thereof. Accordingly, the diameter of the recess 205' will be larger than the diameter of the remaining side walls 208 of the damper housing 215. In this manner, the recess 205' may receive a collar-shaped damper member 223 or collar shaped bladder that fits within the recess 205'. Collar shaped may refer to an annularly shaped object having an opening through the center or interior of the object. The collar-shaped damper member 223 may be selectively retractable and expandable to allow airflow through the damper housing 215 in a first position and to restrict airflow in a second position respectively. In one embodiment, the collar-shaped damper member 223 may be constructed from a pliable material such as rubber. However, any material may be used to construct the collar-shaped damper member 223 including but not limited to plastics and other pliable polymer material as is appropriate for use with the embodiments of the present invention. The collar-shaped damper member 223 may be actuated by pressurized air or other medium that causes the collar-shaped damper member 223 to expand under positive pressure and retract under vacuum or negative pressure. It will be appreciated by persons of ordinary skill in the art that the collar-shaped damper member 223 may be substantially hermetically sealed to maintain the volume of air or other medium pressurized therein for retraction and expansion of the collar-shaped damper member 223.

The collar-shaped damper member 223 may be constructed having a circumference substantially matching the outer diameter of the recess 205' formed in the damper housing 215. The interior periphery of the collar-shaped damper member 223 may substantially match the smaller diameter of the side walls 208 of the damper housing 215 as will be discussed in detail in a subsequent paragraph. To facilitate expansion and retraction, the collar-shaped damper member 223 may be fashioned having one or more lobes 224, shown in FIG. 9 by dashed lines, which expand with pressure to restrict the passageway within the damper assembly 200. When filled with positive air pressure, the lobes 224 may expand inwardly toward a centerline of the damper housing 215. In one embodiment, the expansion of the lobes 224 of the collar-shaped damper member 223 may substantially close off the passageway in the damper assembly 200. However, the lobes 224 may also expand to mostly close off the passageway within damper assembly 200, in this instance allowing only a small volume of air to pass therethrough. In other words, the collar-shaped damper member 223 may be selectively inflated to close the opening in the collar-shaped damper member 223 and the damper housing 215 thereby restricting or inhibiting the flow of air therethrough. Reducing the pressure and drawing a vacuum in the collar-shaped damper member 223 will cause the lobes 224 to retract within the recess 205' thereby widening the opening in the damper assembly 200.

With continued reference to FIG. 8, when the collar-shaped damper member 223 is retracted, the recess 205' may be filled by the collapsed material of the collar-shaped damper member 223 thus forming a substantially contiguous surface over which air in the damper housing may flow. Accordingly, the lobes 224 may retract to align with the side walls 208 of the damper housing forming a smooth flowing surface facilitating laminar flow within the damper assembly 200. In other words, a retracted collar-shaped damper member 223 may comprise a streamline flow profile within the damper housing 215. Conversely, when the collar-shaped damper member 223 is expanded and the opening is restricted, the collar-shaped damper member 223 may comprise a restricted flow profile.

Figure 10:
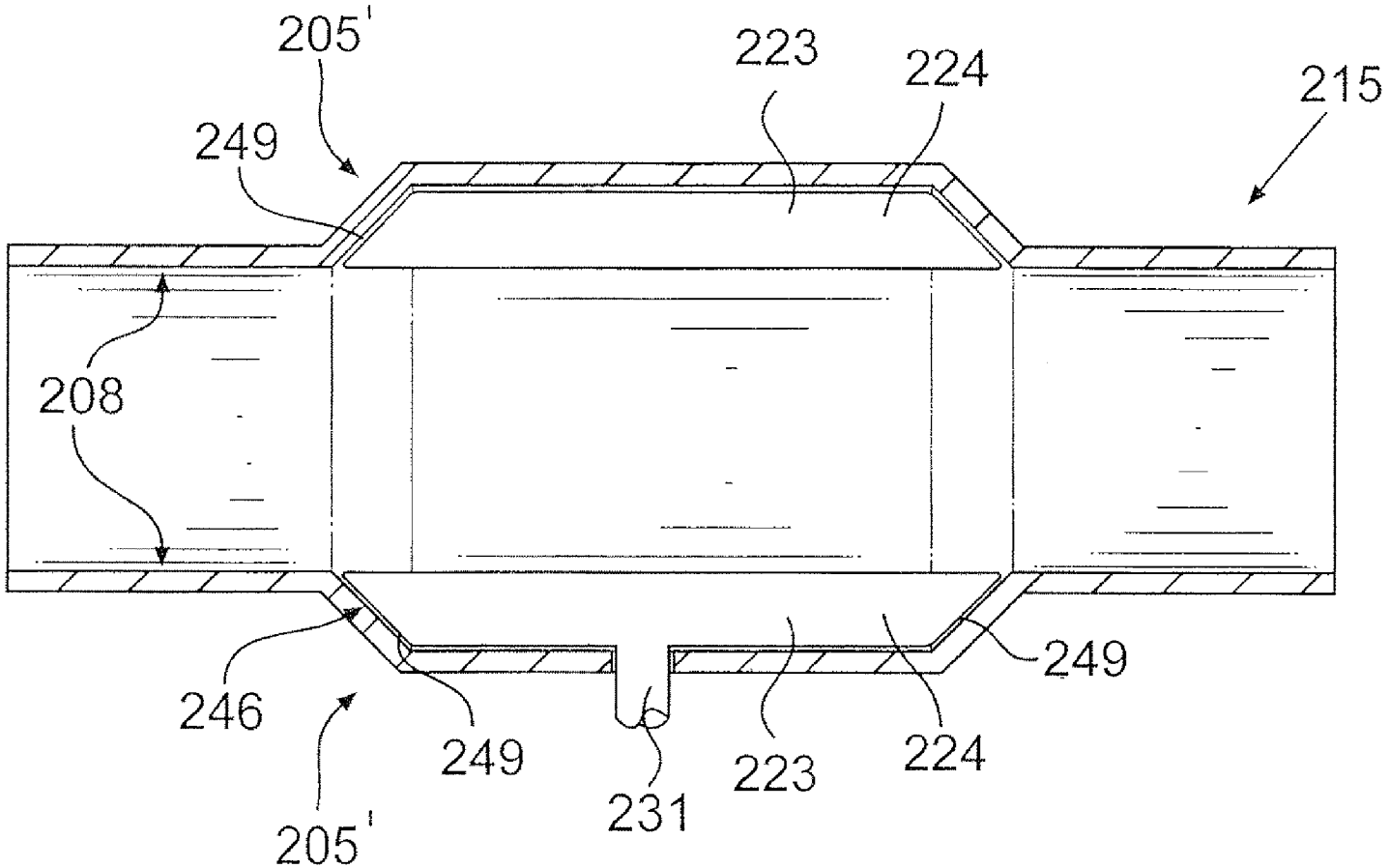
FIG. 10 is a cutaway side view of a damper assembly, in accordance with another embodiment of the present invention.

With reference now to FIG. 10, to assist in the continuance of laminar flow through the damper housing 215, a transition region 246 may extend between the side walls 208 and the recess 205' of the damper housing 215. The transition region 246 may include a chamfered edge 249 that angles downward into the recess 205'. The chamfered edge 249 may be linear forming an acute angle with respect to a centerline axis of the damper housing 215. The chamfered edge 249 may alternatively be curved in either a convex or concave manner. However, any contour, angle or configuration of transition region 246 may be chosen with sound engineering judgment that limits noise generated by the flow of air over the transition surface and that facilitates substantially laminar flow of the medium through the damper assembly 200.

As mentioned above, the damper housing 215 may include first 211 and second 212 ends. The first 211 and second 212 ends may include helical threads 250 fashioned on the exterior of the damper housing 215. The threaded ends 211 and 212 may be used to attach the damper housing 215 to existing ductwork similar to other embodiments described herein. In this manner, existing ductwork may be disassembled and the damper assembly 200 inserted therein and secured together via the helical threads 250 in the ends 211 and 212 of the damper housing 215. Subsequently, appropriately suited ductwork tape may be wrapped around the interface of the existing ductwork and damper assembly 215.

To activate the collar-shaped damper member 223, a supply of pressurized medium, for example air, may be communicated to the collar-shaped damper member 223 via a tube 231 connected to the collar-shaped damper member 223. Resultantly, the collar-shaped damper member 223 will expand like a bladder within the damper housing 215 filling the region thereof and restricting the flow of air in the damper housing 215. To retract or deactivate the damper member, pressure may be relieved from the damper member 215 and a vacuum (negative pressure) drawn through the tube 231 wherein the collar-shaped damper member 223 will retract and open so that air may once again flow through the damper housing 215.

Figure 11:
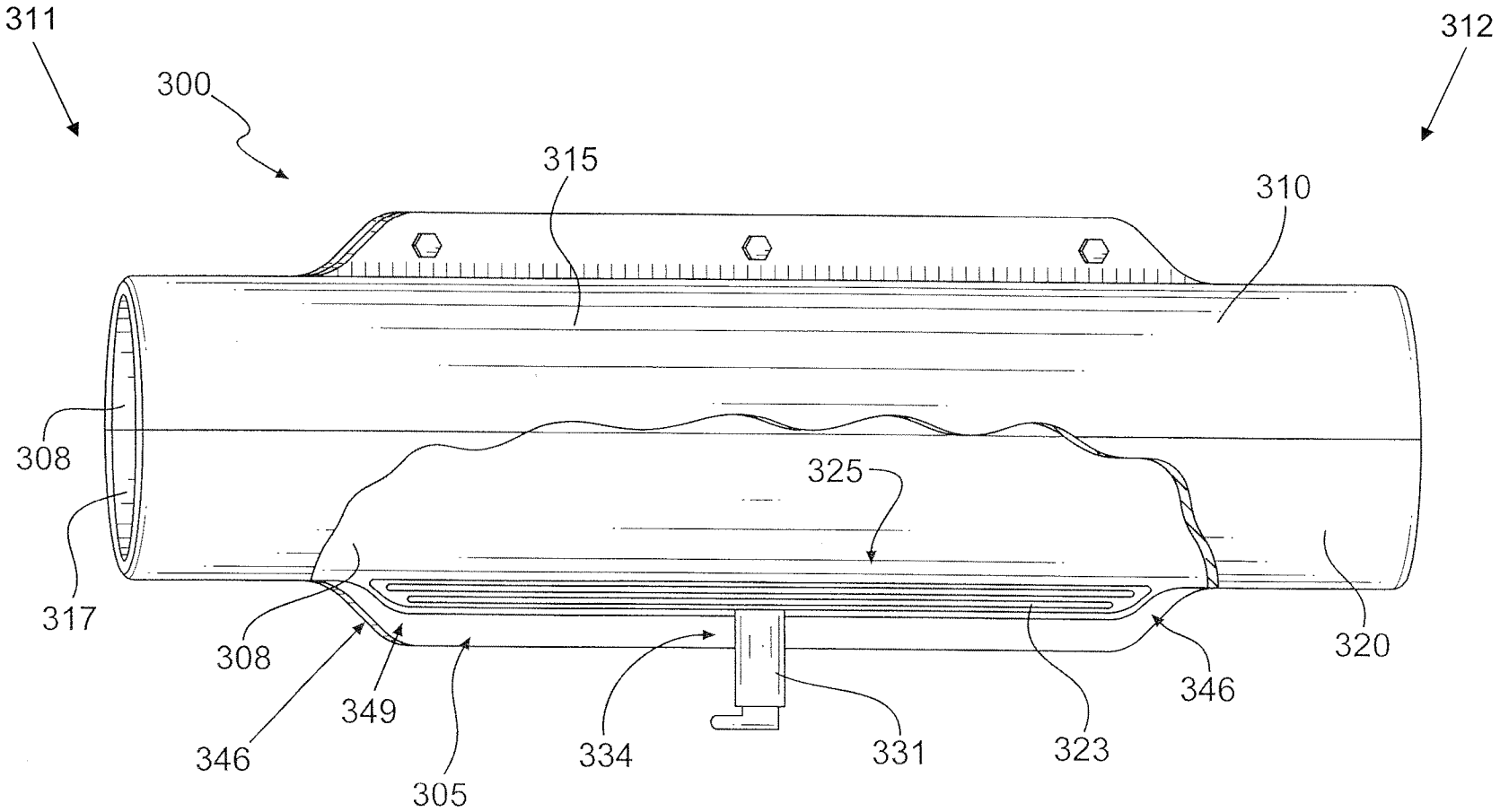
FIG. 11 is a partial cutaway side view of a damper assembly, in accordance with another embodiment of the present invention.
Figure 12:
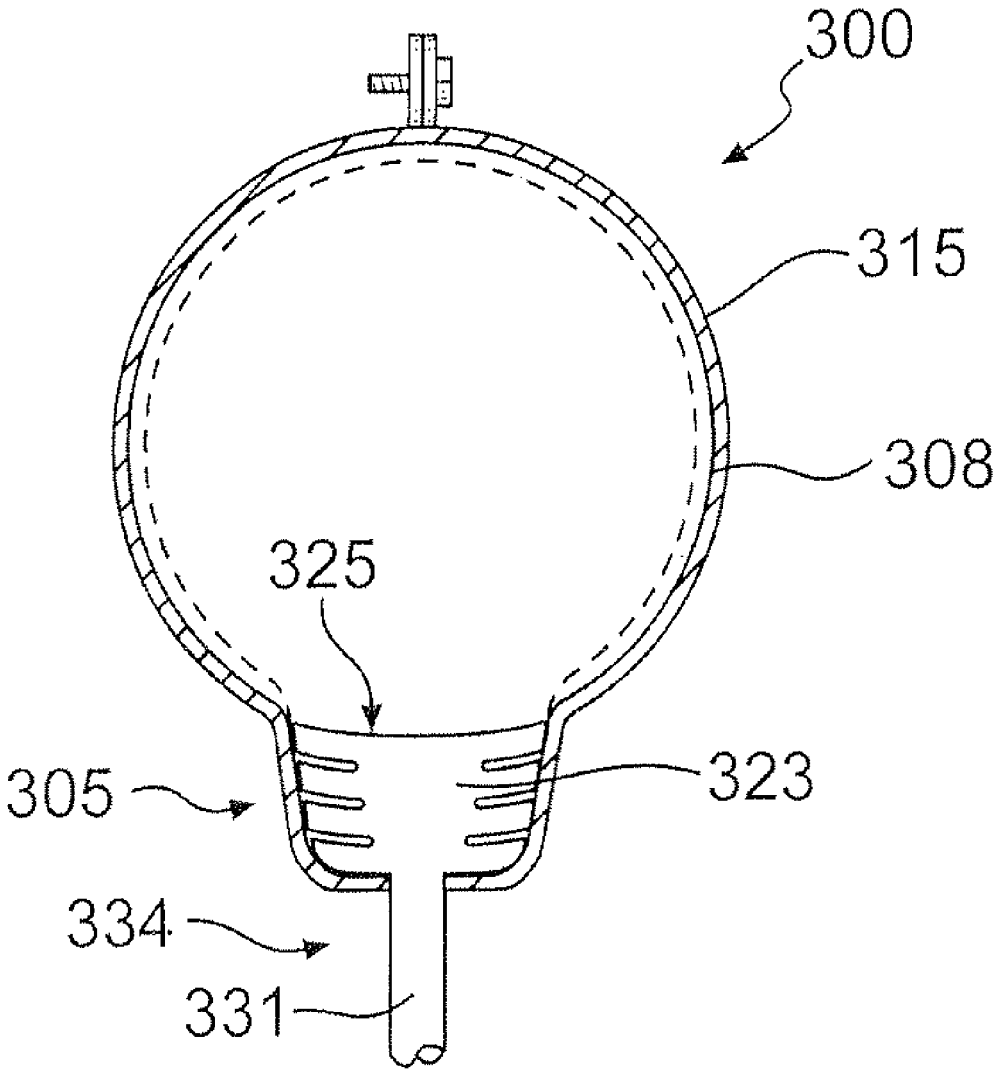
FIG. 12 is a partial cutaway end view of a damper assembly, in accordance with another embodiment of the present invention.

With reference now to FIGS. 11 and 12, an alternate embodiment of the present invention will now be discussed. Similar to the embodiment of damper assembly 200, a damper assembly 300 may comprise first 310 and second 320 damper housing halves that fit together to form a generally cylindrical damper housing 315 having first 311 and second 312 ends. The damper housing 315 may include recess a 305 fashioned within one portion of the damper housing 315. In one embodiment, the recess 305 may be generally rectangular having a characteristic length and shorter width. However, any configuration of recess 305 may be fashioned as chosen with sound engineering judgment. The recess 305 may extend outward with respect to the interior surface 317 of the damper housing 315. The damper assembly 300 may also include a bladder damper member 323 that fits within the recess 305. The bladder damper member 323 may conform to the configuration of the recess 305. In this embodiment, the bladder damper member 323 may be flat having a generally rectangular cross section. The bladder damper member 323 may be selectively expandable from a first retracted position that allows the flow of air through the damper assembly 300 to a second expanded position that restricts airflow. When the bladder damper member 323 is retracted and seated within the recess 305, the upper surface 325 of the bladder damper member 323 may be substantially flush with the interior of the side walls 308 thereby facilitating the flow of air in a laminar fashion through the damper assembly 300. In other words, when retracted the bladder damper member 323 does not substantially protrude into the cylindrical region as defined by the diameter of the side walls 308. Once activated or pressurized, the bladder damper member 323 may be expandable to the second position wherein it extends to substantially fill the interior cavity of the damper housing 315.

With continued reference to FIGS. 11 and 12, the bladder damper member 323 may be constructed from a pliable material such as rubber or another polymer. As such, any type of material may be used to construct the bladder damper member 323 that elastically expands and retracts and that allows the bladder damper member 323 to be hermetically sealed to contain a fluidized medium such as air or other gaseous substances. In this manner, the bladder damper member 323 may be inflated to expand and retract in a manner consistent with the previous description. A tube 331 may be extended from and connected to the bladder damper member 323 to communicate pressurized air for expanding and retracting the bladder damper member 323. The tube 331 may extend outside the damper housing 315 through a channel 334. The channel 334 may be fashioned in the damper housing 315 in any manner chosen with sound engineering judgment. In one embodiment, the channel 334 may be fashioned at least partially in each half 310 and 320 of the damper housing 315 via thermoplastic molding or any other process chosen with sound engineering judgment.

Similar to the previously described embodiment, the damper housing 315 may include a transition region 346 between the sidewalls 308 of the damper housing 315 and the recess 305. Accordingly, the transition region 346 may include a chamfered edge 349 forming an acute angle with a centerline axis of the damper housing 315. However, any configuration of transition region 346 may be formed in the damper housing 315 as is appropriate for reducing noise due to the flow of air through a high velocity small duct conduit.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A damper for controlling the flow of air through high velocity ductwork, the damper comprising:

a damper housing having at least a first side wall enclosing an interior region conveying the laminar flow of high velocity air, the at least a first side wall including first and second side wall end sections at first and second ends of the damper housing, and an expanded side wall section that is spaced outwardly from the first and second side wall end sections and that defines a recessed portion having recessed portion ends that are bounded by a transition region comprised of two edges outwardly inclined with respect to the first and second side wall end sections, wherein the first and second ends are adapted for insertion into associated high velocity ductwork respectively; and, a collar-shaped fillable bladder received within the at least a first side wall facilitating the laminar flow of high velocity air, wherein the collar-shaped fillable bladder defines an enclosed volume and is adapted to expand when filled with an associated medium for substantially closing the interior region from conveying high velocity air; and, wherein the collar-shaped fillable bladder is adapted to retract into the recessed portion creating a substantially flush surface with respect to the interior of the first and second side wall end sections facilitating the laminar flow of high velocity air through the damper.

2. The damper as defined in claim 1, wherein the damper housing is generally tubular; and, wherein the recessed portion is fashioned substantially around the circumference of the generally tubular damper housing; and, wherein the collar-shaped fillable bladder is diametrically received within the recessed portion.

3. The damper as defined in claim 2, wherein the collar-shaped fillable bladder is hermetically sealed to maintain pressurized associated medium.

4. The damper as defined in claim 2, wherein the collar-shaped fillable bladder is constructed from an elastic material.

5. The damper as defined in claim 2, wherein the collar-shaped fillable bladder is constructed from rubber.

6. The damper as defined in claim 1, wherein the first and second ends are threaded for operatively connecting to the associated high velocity ductwork.

7. The damper as defined in claim 1, wherein the damper housing comprises:

a first cylindrically shaped damper housing half having first and second open ends; and, a second cylindrically shaped damper housing half having first and second open ends, wherein said first and second damper housing halves form an assembled damper housing.

8. A damper for controlling the flow of air through high velocity ductwork, the damper comprising:

a damper housing conveying the laminar flow of high velocity air, the damper housing having first and second ends with first and second sidewall end sections and a generally longitudinal recess formed in an expanded sidewall section of the damper housing that is spaced outwardly from the first and second sidewall end sections, the generally longitudinal recess having recess ends that are each bounded by an acutely angled chamfered edge forming an acute angle with respect to a centerline of the damper housing, wherein each of the first and second ends is adapted for insertion into associated high velocity ductwork respectively; and, a collar-shaped fillable bladder damper member that defines an enclosed volume and is expandable when filled with an associated fluid medium to substantially restrict the flow of high velocity air, the collar-shaped fillable bladder damper member being retractable within the generally longitudinal recess of the damper housing facilitating the laminar flow of high velocity air through the damper; and, wherein when the collar-shaped fillable bladder damper member is retracted, the interior of the damper housing is substantially devoid of barriers and creates a substantially flush surface with respect to the interior of the first and second sidewall end sections thereby facilitating the laminar flow of high velocity air through damper.

9. The damper as defined in claim 8, wherein the collar-shaped fillable bladder damper member is constructed from an elastic material, and, wherein the collar-shaped fillable bladder damper member is selectively expandable from a first retracted position defining a streamline flow profile to a second expanded position, wherein when the collar-shaped fillable bladder damper member is in the second expanded position air is substantially inhibited from flowing through the damper housing.

10. The damper as defined in claim 9, further comprising:

a tube extended from the collar-shaped fillable bladder damper member and hermetically sealed with respect to the collar-shaped fillable bladder damper member for communicating pressurized medium to the collar-shaped fillable bladder damper member.

11. The damper as defined in claim 10, wherein the damper housing comprises:

a channel for receiving the tube.

12. The damper as defined in claim 8, wherein the first and second ends are threaded for operatively connecting to the associated high velocity ductwork.

13. The damper as defined in claim 8, wherein the damper housing comprises:

a first cylindrically shaped damper housing half having first and second open ends; and, a second cylindrically shaped damper housing half having first and second open ends, wherein said first and second damper housing halves form an assembled damper housing.

14. A damper for controlling the flow of air through high velocity ductwork, the damper comprising:

a damper housing having a side wall enclosing an interior region conveying the laminar flow of high velocity air, the damper housing including first and second ends with first and second side wall end sections and a recessed portion defined by an expanded side wall section outwardly spaced with respect to the first and second side wall end sections and having recessed portion ends that are each bounded by acutely angled, outwardly sloped edges which form an acute angle with respect to a centerline of the damper housing, wherein the first and second ends are adapted for insertion into associated high velocity ductwork respectively; and, a fillable bladder received within the at least a first side wall facilitating the laminar flow of high velocity air, wherein the fillable bladder includes at least two lobes that expand to restrict the flow of air through the damper housing when filled with an associated medium; and, wherein the fillable bladder is adapted to retract into the recessed portion creating a substantially flush surface with respect to the interior of the first and second side wall end sections thereby facilitating the laminar flow of high velocity air through the damper.

* * * * *